US007805951B2

(12) United States Patent
Bruggeman et al.

(10) Patent No.: US 7,805,951 B2
(45) Date of Patent: Oct. 5, 2010

(54) METHOD AND APPARATUS FOR THE CRUST-FREEZING/COOLING/DEEP-FREEZING TREATMENT OF PRODUCTS

(75) Inventors: Beny Bruggeman, Gent-Wondelgem (BE); Cemal Oztas, Voisins le Bretonneux (FR); Didier Pathier, Voisins le Bretonneux (FR); Robert Taylor, Wavre (BE)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 386 days.

(21) Appl. No.: 10/552,421

(22) PCT Filed: Mar. 24, 2004

(86) PCT No.: PCT/FR2004/050125

§ 371 (c)(1),
(2), (4) Date: Oct. 7, 2005

(87) PCT Pub. No.: WO2004/092668

PCT Pub. Date: Oct. 28, 2004

(65) Prior Publication Data

US 2006/0196194 A1 Sep. 7, 2006

(30) Foreign Application Priority Data

Apr. 7, 2003 (FR) ..... 03 04286

(51) Int. Cl.
*F25D 17/02* (2006.01)

(52) U.S. Cl. ..... 62/64; 62/374

(58) Field of Classification Search ..... 62/64, 62/179, 201, 374, 373

See application file for complete search history.

(56) References Cited

U.S. PATENT DOCUMENTS

| | | | | |
|---|---|---|---|---|
| 3,280,627 | A | 10/1966 | MacKenzie et al. | |
| 3,324,722 | A | 6/1967 | Reicks | |
| 3,755,801 | A | 8/1973 | Milo | |
| 3,889,488 | A | 6/1975 | Maeda et al. | |
| 5,299,426 | A * | 4/1994 | Lermuzeaux | 62/63 |

(Continued)

FOREIGN PATENT DOCUMENTS

| | | |
|---|---|---|
| EP | 0 505 222 | 9/1992 |

(Continued)

OTHER PUBLICATIONS

International Search Report for PCT/FR04/050125.

(Continued)

*Primary Examiner*—Melvin Jones
(74) *Attorney, Agent, or Firm*—Patricia E. McQueeney; Christopher J. Cronin

(57) ABSTRACT

Methods and apparatus for freezing a product. The product is frozen in a treatment container which contains a vibrating support. The vibrating support is capable of receiving a film of a cryogenic liquid. A heated temperature probe, located just before the outlet of the treatment container, measures the temperature at that location. The supply system for the cryogenic liquid has a proportional valve. A data acquisition and processing unit receives the temperature information and controls the opening of the proportional valve.

12 Claims, 3 Drawing Sheets

U.S. PATENT DOCUMENTS

| | | | | |
|---|---|---|---|---|
| 5,454,232 | A * | 10/1995 | Lermuzeaux | 62/374 |
| 5,615,573 | A | 4/1997 | Lee | |
| 5,813,237 | A | 9/1998 | Grace et al. | |
| 6,167,708 | B1 | 1/2001 | Cloarec | |

FOREIGN PATENT DOCUMENTS

| | | |
|---|---|---|
| EP | 0 887 604 | 12/1998 |
| EP | 0 987 506 | 3/2000 |
| FR | 2 808 086 | 10/2001 |
| JP | 53-39536 | 4/1978 |
| JP | 11-37623 | 2/1999 |
| WO | WO 96 00371 | 1/1996 |

OTHER PUBLICATIONS

Examiner's Official Action, dated Mar. 24, 2009 for Japanese Patent Application No.: 2006-505862, 3 pgs.

* cited by examiner

METHOD AND APPARATUS FOR THE CRUST-FREEZING/COOLING/DEEP-FREEZING TREATMENT OF PRODUCTS

BACKGROUND

The present invention relates to the field of methods and installations for the cryogenic treatment of products, particularly food products, the treatment in question being in particular crust-freezing (deep-freezing some or all of the surface of the product), cooling or deep-freezing treatments.

Food products are conventionally frozen in freezing tunnels where the cooling is obtained by mechanical means.

These food products to be frozen are often tacky and adhere to the conveyor belts of the freezing tunnel on which they are carried, thus posing a problem of maintenance and hygiene.

Furthermore, these products may not be very compact and may readily deform, thereby losing their intended shape when they are handled. For example, this is the case with vegetable croquettes which are extremely difficult to handle.

In document EP-A-505 222, the Applicant proposed a novel concept for a method of freezing food products, according to which the product is brought in contact with a refrigerating surface which results from the use of a vibrating support and a liquefied gas, the refrigerating surface consisting of a liquefied gas film arranged on the support.

According to this prior art, the products do not adhere at all to the support even if they are very tacky, despite the thickness of the film possibly being very small, and it seems very likely that the product thus treated floats on the surface of the liquefied gas film by a calefaction effect, and regularly turns over in this film so as to avoid any risk of adhesion to the support.

Typically, this system operates in the following way: a large quantity of liquid nitrogen is injected into the container, which is for example configured with a slightly upward slope. The liquid overspill leaves the apparatus with the products. The nitrogen is then separated from the products by a grille located at the exit of the device. The nitrogen recovered in this way is recycled: it is collected in a reservoir then pumped by a piston pump and returns to the treatment container.

The level of nitrogen is kept substantially constant in the reservoir owing to a valve driven by a probe, which measures the liquid nitrogen level therein.

The nitrogen thus flows in a semi-closed circuit, and leaves the circuit only by evaporation in contact with the products; this loss of nitrogen is compensated for continuously by the supply of the reservoir. The products pass through the container only once.

It should be emphasized that this prior art system has a number of advantages, including:

- the level of liquid nitrogen is stable;
- the treatment of the products is uniform;
- the intensity of the treatment can be adjusted by modifying the slope of the container;
- the treatment time can be adjusted by modifying the amplitude of the vibrations;
- the principle is simple, easy to use and easy to regulate;
- the substantial injection of nitrogen into the container (injection rate=pumping rate) makes it possible to obtain very efficient treatment of the products.

Nevertheless, the Applicant has now realized that this system should be improved, particularly regarding the following aspects:

- certain drawbacks have been found, associated with the presence of the pump which represents the critical element of the system: this pump consumes a non-negligible quantity of compressed air and, when the throughput of the products to be treated is very large, limits the overall cooling capacity of the system by its pumping capacity,
- furthermore, the system poses problems for small and powdered products: this is because the size of the product may become less than the size of the holes in the grille, so that it flows in a closed circuit with the nitrogen, which is clearly unsatisfactory in terms of sanitation.

It can therefore be seen that the drawbacks listed above are essentially connected with the presence of the pump.

SUMMARY

In this context, it is an object of the present invention to provide operating conditions which make it possible to remove this pump, to replace it with a device which can ensure a constant temperature of the products after treatment, and to keep a constant level of nitrogen in the treatment container without requiring nitrogen recycling.

To this end, the invention relates to a method for the total or partial freezing of a product, in particular a food product, according to which, in order to freeze the product on at least one of its surfaces, the product is brought in contact in a treatment container with a refrigerating surface which results from the use of a vibrating support and a film of a cryogenic liquid placed on said support, characterized by the use of the following steps:

- providing a heated temperature probe, which is located in the treatment container just before the exit of the products from the container and which can measure the temperature at the place where it is located,
- providing means for supplying the container with cryogenic liquid, which have a proportional valve;
- providing a data acquisition and processing unit which can receive the temperature information provided by said probe and can retroact if necessary on the opening factor of said proportional valve.

The invention includes both methods and apparatus to achieve the desired results, as described, but is not limited to the various embodiments disclosed.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
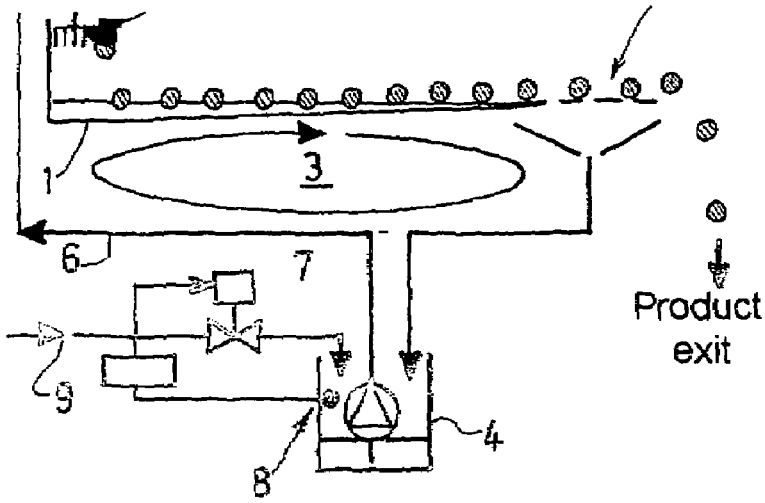
FIG. 1 illustrates a schematic view of one embodiment of a freezing apparatus with a vibrating support.

The present invention relates to methods and apparatus for the total or partial freezing of a product, in particular a food product, by contacting at least one surface of the product with a cryogenic liquid located on a vibrating support.

The method according to the invention may furthermore employ one or more of the following characteristics:

the vibrating support has a slightly downward slope ending in a slight rise which can thus contain a certain quantity of cryogenic liquid, and said temperature probe is located substantially at the position where the cryogenic liquid accumulates, the vibrating support has an upward slope. A grille, which can filter some or all of the cryogenic liquid entrained with the products as they progress upward, is in this case advantageously arranged on some or all of the surface of the vibrating support, the following temperature regulation is furthermore used:

i) a product temperature probe, which can measure the temperature of the products after treatment, is provided in the passage of the products at the exit of the treatment container;

j) a data acquisition and processing unit is provided, which can receive the temperature information provided by said product temperature probe and can retroact if necessary on means for varying the inclination slope of the support and/or on means for varying the vibration frequency of the support and/or on the opening factor of said proportional valve, the following safety regulation is furthermore used:

a) a safety temperature probe is provided in the treatment container, slightly in front of the exit of the products from the container, and can measure the temperature at the place where it is located, b) said means for supplying the container with cryogenic liquid have an on/off valve (safety valve);

c) a data acquisition and processing unit is provided, which can receive the temperature information provided by said safety temperature probe and can retroact if necessary in order to open or close said on/off (safety) valve, the cryogenic liquid is liquid nitrogen.

The present invention also relates to an installation for the total or partial freezing of a product, in particular a food product, comprising a treatment container which comprises a vibrating support capable of receiving a film of a cryogenic liquid, characterized in that it comprises:

a heated temperature probe, which is located in the treatment container just before the exit of the products from the container and which can measure the temperature at the place where it is located, means for supplying the container with cryogenic liquid, which have a proportional valve;

a data acquisition and processing unit which can receive the temperature information provided by said probe and can retroact if necessary on the opening factor of said proportional valve.

The installation according to the invention may furthermore employ one or more of the following characteristics:

the vibrating support has a slightly downward slope ending in a slight rise which can thus contain a certain quantity of cryogenic liquid, and said temperature probe is located substantially at the position where the cryogenic liquid accumulates, the vibrating support has an upward slope. A grille, which can filter some or all of the cryogenic liquid entrained with the products as they progress upward, is in this case advantageously arranged on some or all of the surface of the vibrating support, the installation furthermore comprises:

i) a product temperature probe which is located in the passage of the products at the exit of the treatment container and which can measure the temperature of the products after treatment;

j) a data acquisition and processing unit, which can receive the temperature information provided by said product temperature probe and can retroact if necessary on means for varying the inclination slope of the support and/or on means for varying the vibration frequency of the support and/or on the opening factor of said proportional valve, said means for supplying the container with cryogenic liquid have an on/off safety valve, and the installation furthermore comprises:

a) a safety temperature probe which is located in the treatment container, slightly in front of the exit of the products from the container, and which can measure the temperature at the place where it is located, b) a data acquisition and processing unit, which can receive the temperature information provided by said safety temperature probe and can retroact if necessary in order to open or close said on/off valve.

FIG. 1 represents a schematic view of a freezing installation with a vibrating support according to the prior art, as illustrated by the document EP-A-505222 mentioned previously in the present description.

This schematic view shows the container 1 (the vibration means of which have not been represented here for the sake of clarity) supplied with products 2 to be frozen, and with liquid nitrogen via the intake means 4.

For this embodiment, the container is in an upward slope situation.

The overspill of cryogenic liquid leaves the apparatus with the products. The nitrogen is then separated from the products by a grille system 5.

As can be seen in the figure, the nitrogen recovered in this way is recycled (loop 3) in the following manner: the nitrogen is collected in a reservoir (4) then pumped by a piston pump, and thus returns to the treatment container (return pipe 6).

The level of nitrogen is kept substantially constant in the reservoir owing to a valve 7 driven by a probe 8, which measures the liquid nitrogen level.

In summary:

the nitrogen flows in a semi-closed circuit: it leaves the circuit only by evaporation in contact with the products. This loss of nitrogen is compensated for continuously by the supply of the reservoir with fresh cryogenic liquid (9), the products pass through the container only once.

Figure 2:
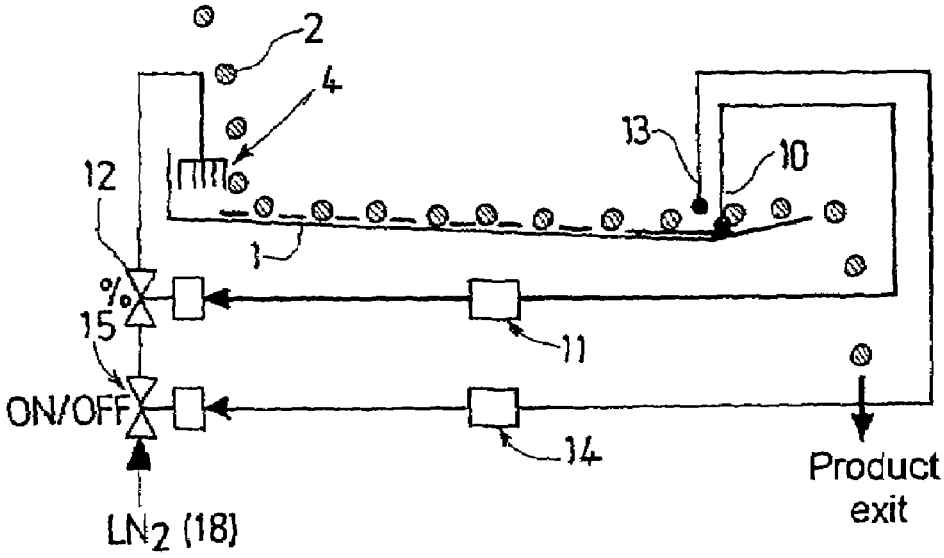
FIG. 2 illustrates a schematic view, according to one embodiment of the current invention, of a freezing apparatus with a vibrating support in downward sloping orientation.

FIG. 2 in turn illustrates an embodiment of the invention which will now be described in detail.

Here, the treatment container 1 is set with a slightly downward slope and ends in a slight rise in order to contain a small quantity of cryogenic liquid.

A temperature probe 10 is placed in the treatment container, slightly in front of the product exit and substantially at the position where the liquid nitrogen accumulates and the level stabilizes.

The temperature read by this probe decreases when the level of nitrogen in the container rises, which has the effect of reducing (via the regulator 11) the opening of a proportional valve 12 (which may be referred to as a "process" valve) and therefore the intake of fresh liquid nitrogen (10). Since the nitrogen supply is reduced, the level descends again and stabilizes.

Similarly, the temperature read by the probe 10 will rise if a decrease of the liquid nitrogen level is observed, which has the effect of increasing the opening factor of the valve 12. Since the injection of nitrogen is enhanced, the nitrogen level will rise again and stabilize.

Thus, while the nitrogen bed in the prior art installations was controlled by the overspill using a closed-circuit recycling pump, here the nitrogen bed is controlled dynamically by continuously adapting the quantity of nitrogen injected into the machine, whatever the consumption of the apparatus.

According to the invention, the temperature probe is of the "heated" type. This is because the work conducted by the Applicant has shown that it is not sensible to use a traditional probe in this situation. In fact, when the level of cryogenic liquid rises and touches the probe, the latter will typically see a temperature close to −200° C., for example. When the liquid level descends again, the probe initially remains surrounded by a very cold gas phase (the temperature of which is close to −200° C.) which means that the probe sees (and therefore reports) only very little difference between the situation when it touches the cryogenic liquid film and the situation when it does not touch it.

Hence the advantage of heating the probe continuously.

An exemplary embodiment of such a heated probe will be described below, specifically a probe of the "double Pt100" type marketed by a large number of suppliers in this field of temperature measurement.

The probe in question is composed of:

- A temperature probe with a platinum resistor operating in the following way, the resistance varies according to the temperature: the resistance is for example 100 ohms at 0° C., and the resistance increases when the temperature increases. Similarly, the resistance decreases when the temperature decreases (for example: 138.51 ohms at 100° C. and 60.26 ohms at −100° C.). An instrument connected to this resistor can measure the resistance value and deduce the temperature therefrom by using a conversion table.
- A second temperature probe with a platinum resistor may be used in the same way, thus making it possible to check the temperature measured by the first probe.
- Two connecting wires attached to the first platinum resistor and two connecting wires attached to the second platinum resistor.
- Stainless steel protection around this assembly: a stainless steel tube plugged at its two ends and allowing the connecting wires to pass through.
- A thermal connection material between the platinum resistor temperature probes and the stainless steel protection.

The traditional use of such a "double Pt100" probe is as follows:

The resistance value of the platinum resistors varies according to the temperature. When the temperature increases, the resistance increases. Similarly, the resistance decreases when the temperature decreases (for example: 138.51 ohms at 100° C. and 60.26 ohms at −100° C.).

The first platinum resistor is connected to an instrument which measures the value of the resistance and deduces the temperature therefrom by using a conversion table. The second platinum resistor temperature probe is used in the same way, and thus makes it possible to check the temperature measured by the first probe.

According to the present invention, this probe is utilized in another way by making it a "heated probe", in the following manner.

The first platinum resistor is supplied continuously with a voltage of 5 volts. It therefore dissipates a variable power according to its temperature (0.25 watt at 0° C.) which causes slight heating that also varies according to the temperature (from +10 to +80° C. depending on the ambient temperature).

The second platinum resistor is used traditionally by being connected to a resistance measuring device with calculation and display of the temperature. The temperature thus measured is therefore influenced by the other platinum resistor, which dissipates power.

The device is then ready to operate close to a level of cryogenic liquid, for example liquid nitrogen:

When the probe is positioned above the liquid nitrogen, without contact with the liquid, the ambient temperature of the gases is very close to −196° C., but with the power dissipation of the first platinum resistor, the temperature of the probe assembly and therefore the measured temperature is about −130° C.

When the probe assembly comes in contact with the liquid nitrogen, the thermal transfer between the probe and the liquid is much greater than when the probe was positioned in a gaseous medium. The temperature then decreases rapidly and approaches −196° C.

This device therefore makes it very easy to determine whether the liquid nitrogen level lies above or below this double temperature probe: If the measured temperature is less than −180° C., this implies that there is contact between the probe and the liquid, but if the measured temperature is above −180° C., this implies that there is no contact between the probe and the liquid.

Experience shows that this device is simple, inexpensive, reliable, readily available and requires no maintenance. Furthermore, since it withstands well the vibrations caused by the vibrating support during operation, it is entirely suitable for measuring and regulating the cryogenic liquid level in this type of machine.

For illustration, if the treatment container is supplied with a large throughput of products to be treated, a large quantity of liquid will be vaporized and the valve 12 will then open sufficiently to compensate for this demand while maintaining a constant temperature of the products at the exit of the machine. If the machine is no longer supplied with products, conversely, the valve 12 will have its opening reduced so as to deliver only the quantity sufficient to maintain the level in the container (keeping the machine cold).

The presence of a second injection control can also be seen in FIG. 2, the purpose of which is not to adjust the quantity of liquid nitrogen injected but to cut the supply if the system (probe 13, regulator 14, on/off valve 15) drifts. If the regulation of the injection as described above drifts for an unknown reason, therefore, the liquid nitrogen will accumulate at the low point of the apparatus, at the position where the slope of the container changes. The probe 13 will then detect any abnormal rise of the nitrogen level by a drop in temperature. When this level reaches an allowed maximum (setpoint), it will cut the nitrogen supply to the system via the safety valve 15 before the liquid can reach the edge of the container. Any risk of overflow will then be averted.

Here again, in view of its situation, the safety probe is preferably of the "heated" type.

The valve 15 then operates according to the following logic:

Level less than maximum tolerated level→valve open;

Level greater than or equal to the maximum tolerated level→valve closed.

FIG. 2 has just illustrated a downward slope configuration. At the position where the slope changes, a small "pool" is typically created with a depth of close to 0.5 cm (this is given only as an illustration of the orders of magnitude) while upstream of the slope, facing the exit of the means 4, the depth is almost zero (nitrogen runoff).

Figure 3:
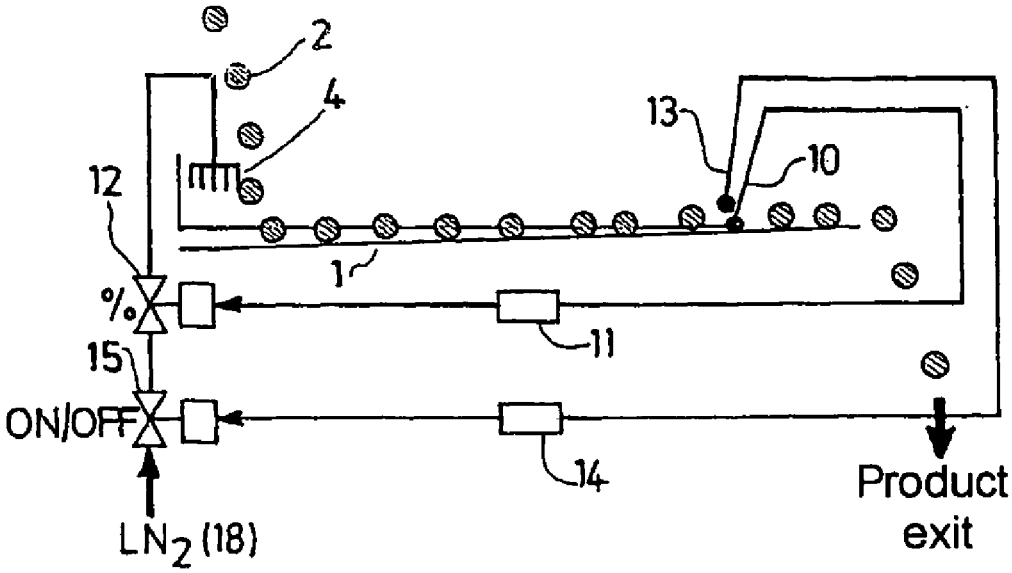
FIG. 3 illustrates a schematic view, according to one embodiment of the current invention, of a freezing apparatus with a vibrating support in an upwardly sloping orientation.

FIG. 3 in turn illustrates a container in an upward slope position with the same constituent elements, and therefore the same numerical references.

In fact, although the installation of FIG. 2 is more particularly suitable for small products (such as potato powders, grated cheese, etc.), the nitrogen level of the treatment container with a downward slope may prove insufficient for some larger products (such as poultry cubes).

Orienting the container with a slightly upward slope makes it possible to create a nitrogen bed at the bottom of the container on the product entry side (typically a depth of close to 2 cm upstream of the slope, while the depth at the end of the upward slope is close to 0).

Owing to the "bath" effect thus created, the treatment is more intensive.

It should be noted that in this upward slope situation, it is highly advantageous to provide a grille (not shown) over some or all of the surface of the vibrating support 1, which can filter some or all of the cryogenic liquid entrained with the products as they progress upward. The cryogenic liquid "filtered" in this way then descends again toward the upstream side of the upward slope.

In the case of either FIG. 2 or FIG. 3, the losses of cryogenic liquid are very small.

In summary, the embodiments of the invention as illustrated in FIGS. 2 and 3 make it possible to omit the pump of the prior art while keeping constant the amount of cooling (negative calories) received by the product.

The embodiments explained here will be referred to below as "level regulation".

Figure 4:
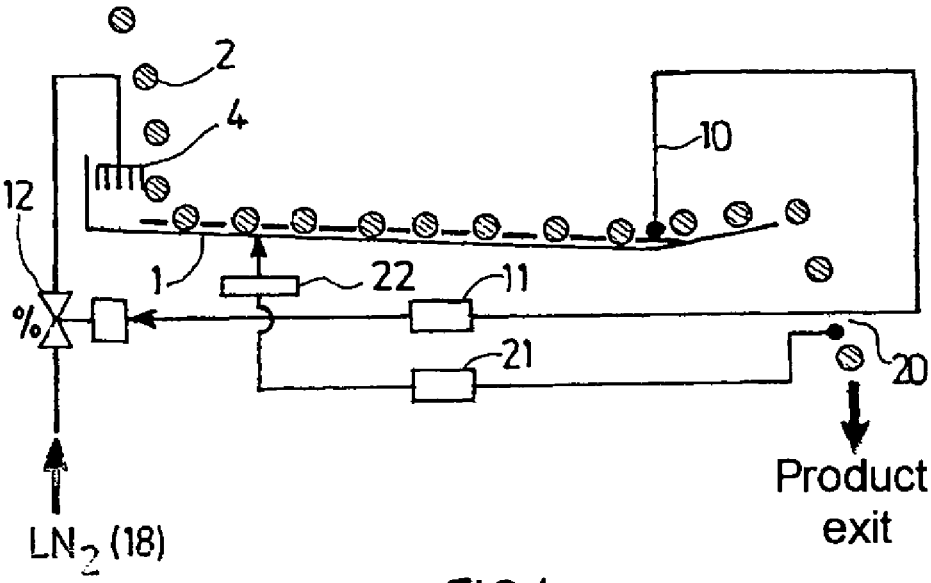
FIG. 4 illustrates a schematic view, according to a second embodiment of the current invention, of a freezing apparatus with a vibrating support in a downward sloping orientation.
Figure 5:
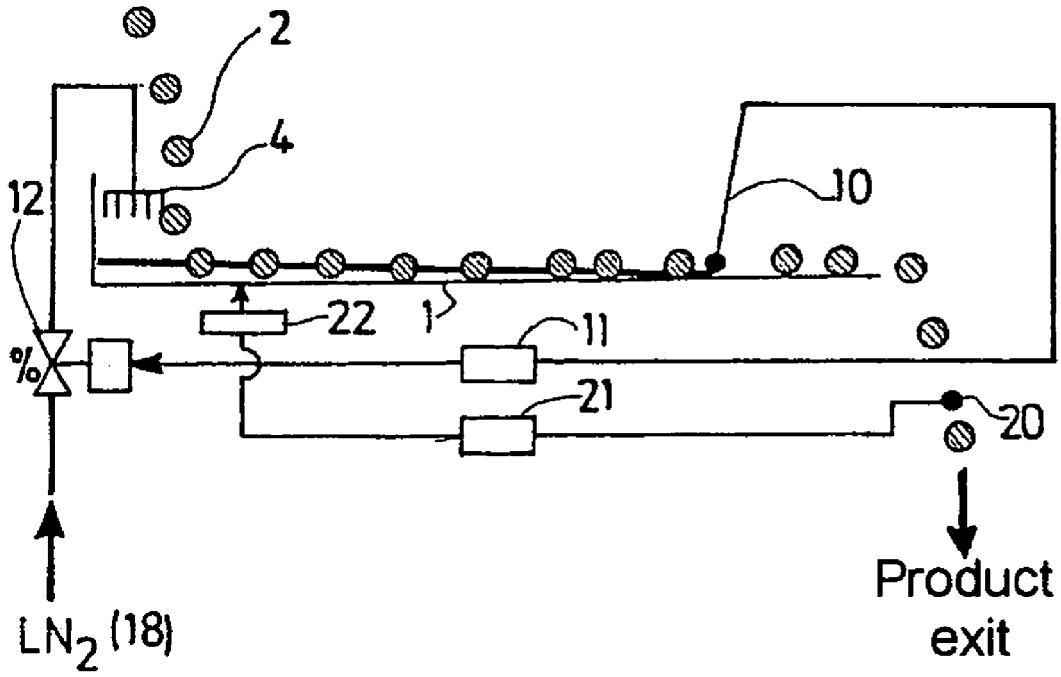
FIG. 5 illustrates a schematic view, according to a second embodiment of the current invention, of a freezing apparatus with a vibrating support in an upwardly sloping orientation.

FIGS. 4 and 5 illustrate an advantageous embodiment of the invention (respectively in downward and upward slope situations) in which a probe for measuring the exit temperature of the products is furthermore used.

In fact, it has been found that for some user sites where the initial temperature of the incoming products can vary substantially from one time of day to another, the level regulation illustrated above in FIGS. 2 and 3 may be found to perform unsatisfactorily. According to the present invention, it is then more particularly advantageous to apply regulation to the exit temperature of the products in addition, as described below. As will be seen, this regulation will furthermore make it possible to adapt the temperature drop applied to the products.

In this situation, the "product" temperature probe is situated in a less rigorous environment than the temperature probe present at the exit of the container, and this "product" temperature probe may therefore be of the traditional (unheated) type.

FIG. 4 shows the container 1, supplied with products 2 to be frozen and with liquid nitrogen via the intake means 4. Here, the treatment container 1 is set with a slightly downward slope and ends in a slight rise in order to contain a small quantity of cryogenic liquid.

According to the invention, a heated temperature probe 10 is placed in the treatment container, slightly in front of the product exit and substantially at the position where the liquid nitrogen accumulates and the level stabilizes, and as described above makes it possible to regulate the quantity of fresh cryogenic liquid re-injected into the system via the valve 12 and the regulator 11.

This embodiment, however, also monitors the final temperature of the products after treatment via the probe 20 and, according to the result of this monitoring, retroacts as appropriate on the slope of the container 1 and/or on the vibration frequency (via the unit 21 and the means 22 for varying the slope of the container and/or the vibration frequency).

As a variant (not shown), it is also possible to retroact on the opening factor of the valve 12.

The system thus adapts its operation so as to obtain a constant temperature of the products, irrespective of the initial conditions of input rate and initial temperature.

This embodiment will be referred to below as "temperature regulation".

For illustration:

in the case of retroaction on the vibration frequency: if the products reentering the system are too hot for an unknown or miscellaneous reason, then the level regulation described above which applies a constant temperature drop may prove insufficient and lead to products which also emerge too hot.

The system will then retroact on the vibration frequency in order to modify the transit time of the products through the container, in the example mentioned here by reducing the vibration frequency, which will make it possible to agitate the products less rapidly along their path and therefore leave them in the liquid nitrogen for longer (and thus reach the desired lower temperature by successive iterations).

in the case of retroaction on the slope of the container: here, the adjustment will affect the depth of liquid nitrogen to which the product is exposed.

Still in the example where the products reenter the system too hot, the system will in this case reduce the downward slope or even, in certain cases, create an upward slope so as firstly to slow the rate of progress of the products through the container and secondly to create a cryogenic liquid bed, and increase its depth according to requirements.

The treatment time will be longer, and the contact of the product with the liquid will then be more complete and more intense, which will make it possible to lower the final temperature of the products to the desired level by successive iterations.

It should be noted that although the safety control described above in the context of FIGS. 2 and 3 (13/14/15) has not been described here in the context of FIGS. 4 and 5, it may readily and even very advantageously be present as well to supplement the "level" and "temperature" regulations.

The advantages of the invention ("level regulation" optionally supplemented by the "temperature regulation") may then be described as follows:

elimination of the pump and the cross-contaminations due to the recirculation of nitrogen;

the temperature of the products after treatment is stable, whatever the rate of incoming products and their temperature before treatment;

the treatment time can be adjusted by modifying the slope of the apparatus;

powders can be treated (this has been done successfully for potato powders or chocolate powders);

the equipment is very simple to clean because it involves very few mechanisms;

the reliability of the system is very greatly improved. In particular, the risks of breakdown associated with the pump are eliminated;

there is no recycling circuit, and the nitrogen losses are therefore minimized.

For medium-sized products it will be advantageous to use the embodiment of FIG. 5, which is identical to that of FIG. 4 in all regards apart from the fact that the container is in an upward slope situation.

Although the invention has been more particularly illustrated above with reference to liquid nitrogen, other cryogenic liquids may be envisaged without departing from the scope of the invention in any way.

Likewise, besides the food products to which the invention more particularly relates, it is also possible to treat industrial products such as fatty materials or waxes whose melting points are close to ambient temperature.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method which may be used for freezing a food product, said method comprising:

a) freezing at least one surface of the food product, wherein said freezing:
   1) comprises bringing said food product into contact with a refrigerating surface;
   2) takes place in a treatment container; and
      3) results from the use of a vibrating support and a film of a cryogenic liquid placed on said vibrating support, wherein said vibrating support has an upward slope;

b) providing a first heated temperature probe at a location immediately prior to an exit of said food product from said treatment container, wherein said first heated temperature probe measures a temperature at its location:

c) providing a cryogenic liquid supply system, wherein said cryogenic liquid supply system comprises a proportional valve;

d) providing a first data acquisition and processing unit which receives temperature information from said first heated temperature probe, and which can control an opening of said proportional valve; and e) providing a grill, wherein:
   a) said grill is substantially located on said refrigerating surface of said vibrating support; and
   b) said grill removes at least part of said cryogenic liquid from said food products as said food products pass over said grill.

2. A method which may be used for freezing a food product, said method comprising:

a) freezing at least one surface of the food product, wherein said freezing:
   1) comprises bringing said food product into contact with a refrigerating surface;
   2) takes place in a treatment container; and
   3) results from the use of a vibrating support and a film of a cryogenic liquid placed on said vibrating support;

b) providing a first heated temperature probe at a location immediately prior to an exit of said food product from said treatment container, wherein said first heated temperature probe measures a temperature at its location:

c) providing a cryogenic liquid supply system, wherein said cryogenic liquid supply system comprises a proportional valve;

d) providing a first data acquisition and processing unit which receives temperature information from said first heated temperature probe, which can control an opening of said proportional valve;

e) providing a product temperature probe, wherein said product temperature probe:
   1) is located in the passage of said food products at an exit of said treatment container; and
   2) measures a product temperature after freezing; and f) providing a second data acquisition and processing unit, wherein said second data acquisition and processing unit:
   1) receives temperature information from said product temperature probe; and
   2) controls at least one member selected from the group consisting of:
      i) an inclination slope of said vibrating support;
      ii) a frequency of vibration of said vibrating support; and
      iii) the opening of said proportional valve.

3. A method which may be used for freezing a food product, said method comprising:

a) freezing at least one surface of the food product, wherein said freezing:
   1) comprises bringing said food product into contact with a refrigerating surface;
   2) takes place in a treatment container; and
   3) results from the use of a vibrating support and a film of a cryogenic liquid placed on said vibrating support;

b) providing a first heated temperature probe at a location immediately prior to an exit of said food product from said treatment container, wherein said first heated temperature probe measures a temperature at its location;

c) providing a cryogenic liquid supply system, wherein said cryogenic liquid supply system comprises a proportional valve;

d) providing a first data acquisition and processing unit which receives temperature information from said first heated temperature probe, and which can control an opening of said proportional valve;

e) providing a safety temperature probe in said treatment container, wherein said safety temperature probe:
   1) is located slightly in front of said food product's exit from said treatment container; and
   2) measures a temperature at its location;

f) providing an on/off valve for said cryogenic liquid supply system; and g) providing a third data acquisition and processing unit, wherein said third data acquisition and processing unit:
   1) receives temperature information from said safety temperature probe; and
   2) can control said on/off valve in order to open or close said on/off valve.

4. The method of claim 3, wherein said safety temperature probe is a heated probe.

5. The method of claim 4, wherein:

a) said safety temperature probe or said first heated temperature probe is a double probe comprising a first and a second resistor;

b) said first resistor is connected to an instrument which measures resistance and deduces said temperature from a conversion table; and c) said second resistor is supplied with a voltage which generates heat.

6. An apparatus which may be used to freeze a product, said apparatus comprising:

a) a treatment container for at least one product, wherein said treatment container comprises:

1) a vibrating support capable of receiving a film of a cryogenic liquid, wherein said vibrating support has an upward slope;

2) an inlet; and 3) an outlet;

b) a first heated temperature probe located before said outlet, wherein said first heated temperature probe measures a temperature at its location;

c) a supply system for said cryogenic liquid, wherein said supply system comprises a proportional valve;

d) a first data acquisition and processing unit, wherein said first data acquisition and processing unit is capable of:

1) receiving temperature information from said first heated temperature probe; and 2) controlling an opening of said proportional valve; and e) a grill substantially located on a surface of said vibrating support, wherein said grill is capable of filtering at least part of said cryogenic liquid contained in said product as said product passes over said grill.

7. An apparatus which may be used to freeze a product, said apparatus comprising:

a) a treatment container for at least one product, wherein said treatment container comprises:

1) a vibrating support capable of receiving a film of a cryogenic liquid;

2) an inlet; and 3) an outlet;

b) a first heated temperature probe located before said outlet, wherein said first heated temperature probe measures a temperature at its location;

c) a supply system for said cryogenic liquid, wherein said supply system comprises a proportional valve;

d) a first data acquisition and processing unit, wherein said first data acquisition and processing unit is capable of:

1) receiving temperature information from said first heated temperature probe; and 2) controlling an opening of said proportional valve;

e) a product temperature probe located near said outlet, wherein said product temperature probe is capable of measuring a temperature of said product as it leaves said treatment container; and f) a second data acquisition and processing unit, wherein said second data acquisition and processing unit:

1) receives temperature information from said product temperature probe; and 2) controls at least one member selected from the group consisting of:

i) an inclination slope of said vibrating support;

ii) a frequency of vibration of said vibrating support; and iii) the opening of said proportional valve.

8. An apparatus which may be used to freeze a product, said apparatus comprising:

a) a treatment container for at least one product, wherein said treatment container comprises:

1) a vibrating support capable of receiving a film of a cryogenic liquid;

2) an inlet; and 3) an outlet;

b) a first heated temperature probe located before said outlet, wherein said first heated temperature probe measures a temperature at its location;

c) a supply system for said cryogenic liquid, wherein said supply system comprises a proportional valve;

d) a first data acquisition and processing unit, wherein said first data acquisition and processing unit is capable of:

1) receiving temperature information from said first heated temperature probe; and 2) controlling an opening of said proportional valve;

e) an on/off valve for said supply system;

f) a safety temperature probe located near said outlet, wherein said safety temperature probe is capable of measuring a temperature at its location; and g) a third data acquisition and processing unit, wherein said third data acquisition and processing unit:

1) is capable of receiving temperature information from said safety temperature probe; and 2) is capable of controlling the opening or closing of said on/off valve.

9. The apparatus of claim 8, wherein said safety temperature probe is a heated probe.

10. The apparatus of claim 9, wherein:

a) said safety temperature probe or said first heated temperature probe is a double probe comprising a first and a second resistor;

b) said first resistor is connected to an instrument which measures resistance and deduces said temperature from a conversion table; and c) said second resistor is supplied with a voltage which generates heat.

11. An apparatus which may be used to freeze a product, said apparatus comprising:

a) a treatment container for at least one product, wherein said treatment container comprises:

1) a vibrating support capable of receiving a film of a cryogenic liquid;

2) an inlet; and 3) an outlet;

b) a first heated temperature probe located before said outlet, wherein said first heated temperature probe measures a temperature at its location;

c) a supply system for said cryogenic liquid, wherein said supply system comprises a proportional valve;

d) a first data acquisition and processing unit, wherein said first data acquisition and processing unit is capable of:

1) receiving temperature information from said first heated temperature probe; and 2) influencing an opening of said proportional valve;

e) a product temperature probe located near said outlet, wherein said product temperature probe is capable of measuring a temperature of said product as it leaves said treatment container;

f) a second data acquisition and processing unit, wherein said second data acquisition and processing unit:

1) receives temperature information from said product temperature probe; and 2) controls at least one member selected from the group consisting of:

i) an inclination slope of said support;

ii) a frequency of vibration of said support; and iii) the opening of said proportional valve;

g) an on/off valve for said supply system;

h) a safety temperature probe located near said outlet, wherein said safety temperature probe is a heated probe capable of measuring a temperature at its location; and i) a third data acquisition and processing unit, wherein said third data acquisition and processing unit:

1) is capable of receiving temperature information from said safety temperature probe; and 2) is capable of influencing an opening or closing of said on/off valve.

12. The apparatus of claim 11, wherein:

a) said safety temperature probe or said first heated temperature probe is a double probe comprising a first and a second resistor;

b) said first resistor is connected to an instrument which measures resistance and deduces said temperature from a conversion table; and c) said second resistor is supplied with a voltage which generates heat.

* * * * *